US007503110B2

(12) United States Patent
Domitrovits et al.

(10) Patent No.: US 7,503,110 B2
(45) Date of Patent: Mar. 17, 2009

(54) METHOD FOR REMOVING PRESS-FIT COMPONENTS FROM PRINTED CIRCUIT BOARDS

(75) Inventors: Michael J. Domitrovits, New Paltz, NY (US); Raymond F. Frizzell, Jr., Staatsburg, NY (US); Francis R. Krug, Highland Corners, NY (US)

(73) Assignee: International Business Machines Corporation, Armonk, NY (US)

( * ) Notice: Subject to any disclaimer, the term of this patent is extended or adjusted under 35 U.S.C. 154(b) by 23 days.

(21) Appl. No.: 11/626,623

(22) Filed: Jan. 24, 2007

(65) Prior Publication Data

US 2008/0172853 A1 Jul. 24, 2008

(51) Int. Cl.
*H01R 43/02* (2006.01)
*H01R 9/00* (2006.01)

(52) U.S. Cl. ..... 29/845; 29/877; 29/762; 29/764; 29/426.5; 439/74

(58) Field of Classification Search ..... 29/729, 29/739, 751, 762, 764, 758, 426.1, 426.4, 29/278, 832–834, 845–847, 876–882; 439/852, 439/628, 74, 75, 78; 156/98, 230, 247
See application file for complete search history.

(56) References Cited

U.S. PATENT DOCUMENTS

| | | | | |
|---|---|---|---|---|
| 4,215,468 | A * | 8/1980 | Greco | 29/764 |
| 4,984,355 | A * | 1/1991 | Lubrano et al. | 29/741 |
| 5,038,467 | A * | 8/1991 | Murphy | 29/845 |
| 5,329,693 | A * | 7/1994 | Smith | 29/764 |
| 6,779,256 | B2 * | 8/2004 | Kappel et al. | 29/764 |

* cited by examiner

*Primary Examiner*—Minh Trinh
(74) *Attorney, Agent, or Firm*—John E. Campbell; Jose Gutman; Fleit Gibbons Gutman Bongini & Bianco P.L.

(57) ABSTRACT

A method is provided for removing a component from a medium. The method includes applying an adhesive to a portion of a component. An attachment member is inserted into the portion of the component. The attachment member is pulled with a pulling element in a direction opposite a medium in which the component is inserted.

6 Claims, 9 Drawing Sheets

Board Support

METHOD FOR REMOVING PRESS-FIT COMPONENTS FROM PRINTED CIRCUIT BOARDS

FIELD OF THE INVENTION

The present invention relates, in general, to the removal of components attached to PCBs, and more particularly relates to a tool and adhesion method for removing press-fit components without breaking components or damaging the PCBs.

BACKGROUND OF THE INVENTION

Printed circuit boards (PCBs) are present in virtually every electrical device on the market today. PCBs have electrically conductive pathways, or "traces," running from node to node across the board and, in many cases, through the board to the other side or within layers between board surfaces. PCBs also have plated thru-holes that accept legs of components so as to provide solid electrical connections between the components and the traces.

Previously, all components were attached to PCBs with solder. Removing the components simply required heating the board to the melting point of the solder and pulling the component out of the thru-hole. However, solder is messy, difficult to control and requires multiple processes for application, heating, and cleaning.

To avoid the complications associated with solder, many components became available with press-fit legs. Press-fit legs apply positive pressure to the interior walls of the thru-holes so as to make a solid electrical connection with the plating on the thru-hole walls and to also resist removal from the holes. Each press-fit pin provides about five pounds of resistance to removal.

Virtually all components have multiple pins, which make the needed removal force additive. For instance, some components require as much as 3,000 psi for removal. Therefore, simply pulling a press-fit component to remove it is not a viable removal technique because it results in destruction of the component on the PCB and often times, the PCB itself. The risks associated with this process include damage to the plated thru-hole, uncontrolled debris being lost with the potential of shorting various other components on the board, and scrapping the board entirely due to destruction.

One specific known removal method includes pressing compliant pins from the bottom side of the PCB. However, for several reasons, simply pressing on the compliant pins from the back side is not an efficient removal method. On thicker PCBs, flat rock tooling will not work because the tail does not protrude through the board enough to extract the compliant section of the pin. Great care must be taken to ensure that the removal tool is aligned with all of the thru-holes so that the PTH is not damaged. Given the small physical size of these pins presents a challenge as well. In addition, the compliant tails are not always robust enough to support the extraction force required to press the pin out of the board causing the pin to buckle, scrapping the PCB. Another thing to consider is the pressure on the back side of the PCB, which must be large enough to force all of the pins out, thereby putting great pressure on the board, possibly breaking the board and/or the traces. One additional known method of removing press-fit pins involves pulling of individual pins, often by hand. This method is not a clean process, is not controlled, and is labor intensive.

Therefore a need exists to overcome the problems with the prior art as discussed above.

SUMMARY OF THE INVENTION

Briefly, in accordance with the present invention, disclosed is a method and apparatus for removing a component from a medium. In one embodiment, the apparatus includes an attachment member that is insertable into a portion of a component. The apparatus also includes an amount of adhesive for adhering the attachment member to the component and a pulling element that is operable to exert force on the attachment member in a direction away from a medium in which the component is inserted.

In accordance with an added feature of the present invention, the pulling element includes at least one leg for making contact with the medium and a tensioner mechanically coupled to the attachment member and the at least one leg, whereby the tensioner is operable for causing the attachment member to move in a direction away from the at least one leg and the medium.

According to another feature of the present invention, the tensioner is a threaded member. The tensioner can also be a press that exerts pressure in a direction toward the board.

In accordance with yet another feature, an embodiment of the present invention further includes a second leg opposing the at least one leg so as to sandwich the attachment member, wherein the second leg is mechanically coupled to the tensioner and the at least one leg.

In accordance with a further feature, an embodiment of the present invention can include at least one lever arm that has a center section pivotably attached to the at least one leg, a first end able to make contact with the attachment member, and a second end movable by the tensioner for causing the center section to pivot and move the attachment member in a direction opposite the at least one leg.

In accordance with yet anther added feature, the attachment member can have a blade shape.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly.

The present invention, according to an embodiment, overcomes problems with the prior art by providing a device and method for removing press-fit components, or any components with compliant pins from any medium by utilizing a component-mating module secured to the component by an adhesive. The module pulls the pins, rather than pushing them. The pulling force is advantageous in that it induces less thru-hole barrel deformation and does not require penetration into the back side of the thru-hole barrels.

Figure 1:
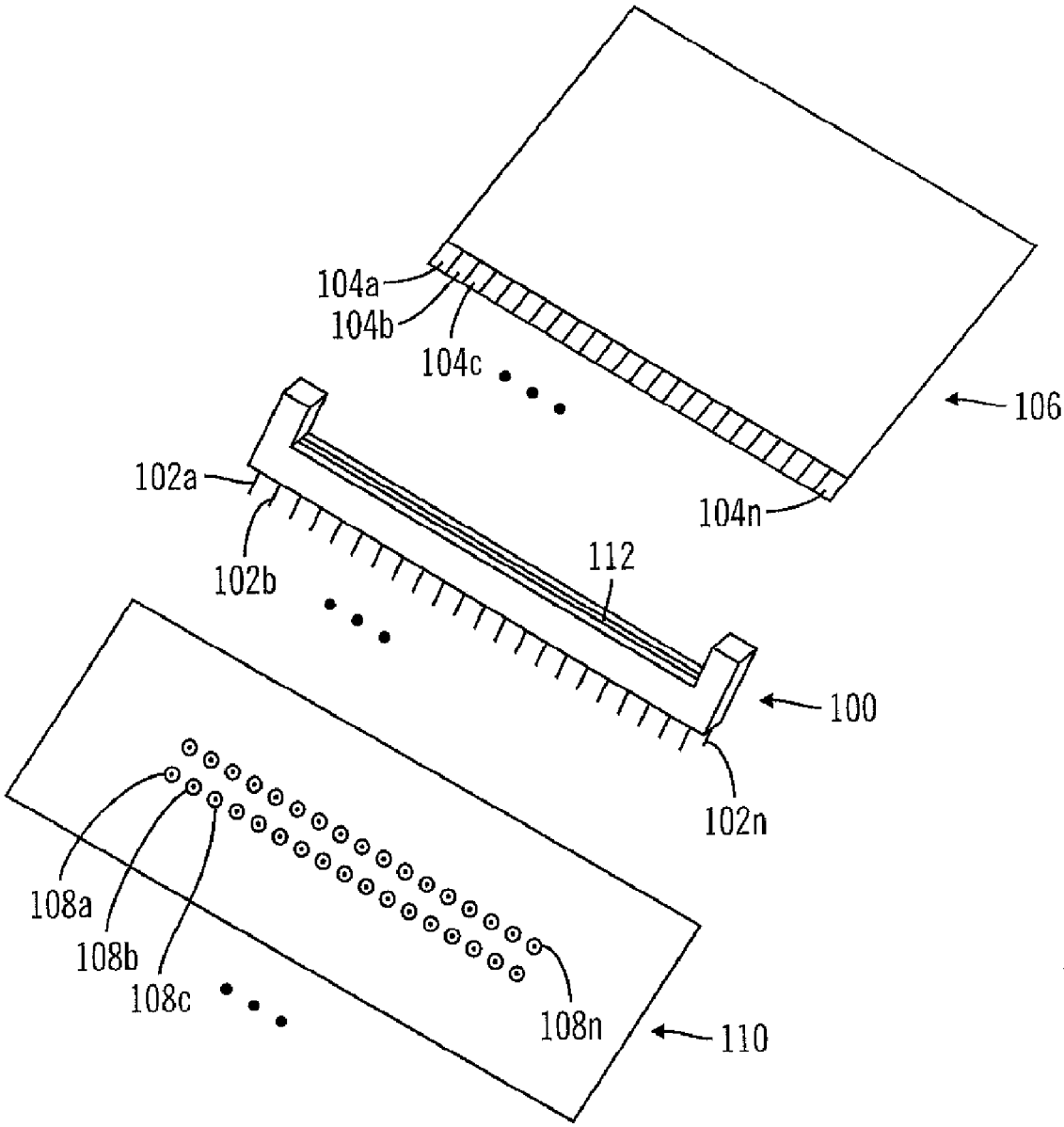
FIG. 1 is an elevational view of a PCB, component, and card according to an embodiment of the present invention.

FIG. 1 shows an example of a component 100 with press-fit pins 102*a-n* that can be removed from a PCB 110 with the present invention. The particular component 100 shown is often referred to as a "socket" and is useful for mating contact areas 104*a-n* on a blade-shaped "card" 106 to thru-hole contact pads 108*a-n* on a PCB 110. It should be noted that the present invention is not limited to socket components, nor is it limited to components that accept cards only.

The component 100 shown has an elongated void or slot 112 that accepts the card 106. In the example shown, the slot is provided with pins on both sides. The pins on one side make contact with pads on a first side of the card 106 and the pins on the opposing side make contact with contact pads that are present on the other side of the card 106.

Figure 2:
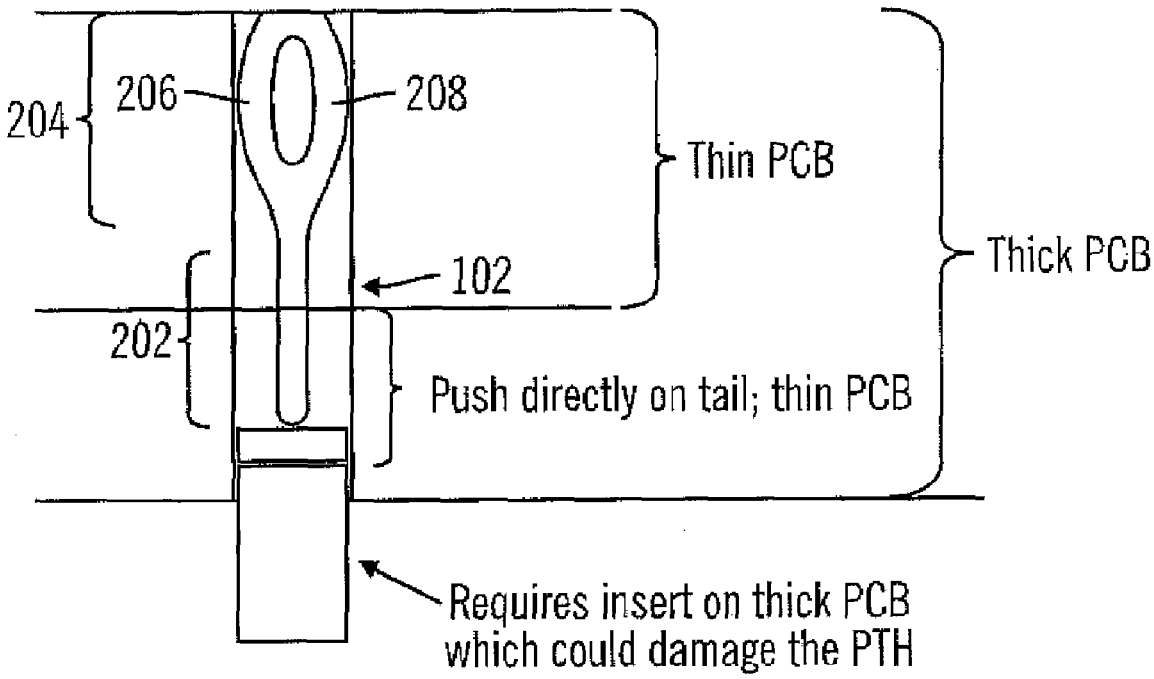
FIG. 2 is a side view of a press-fit pin of the component of FIG. 1 extending below the component according to an embodiment of the present invention.

Once the pins 102 are inserted into a thru-hole 108 with an amount of force, the pins 102 exert pressure on the inside of the holes 108. FIG. 2 shows a side-view close up of all exemplary press-fit pin 102. The pin 102 includes an insertion section 202 that is the first part of the pin to enter a hole. The pin 102 also includes a tension section 204 that has two portions 206 and 208. Once the pin 102 is inserted into a hole with a diameter smaller than an outer dimension of the upper section 204 of the pin 200, the two portions 206 and 208 are compressed towards each other. Removal of the pin then requires enough force to overcome the frictional force exerted by the compressed sections 206 and 208.

Figure 3:
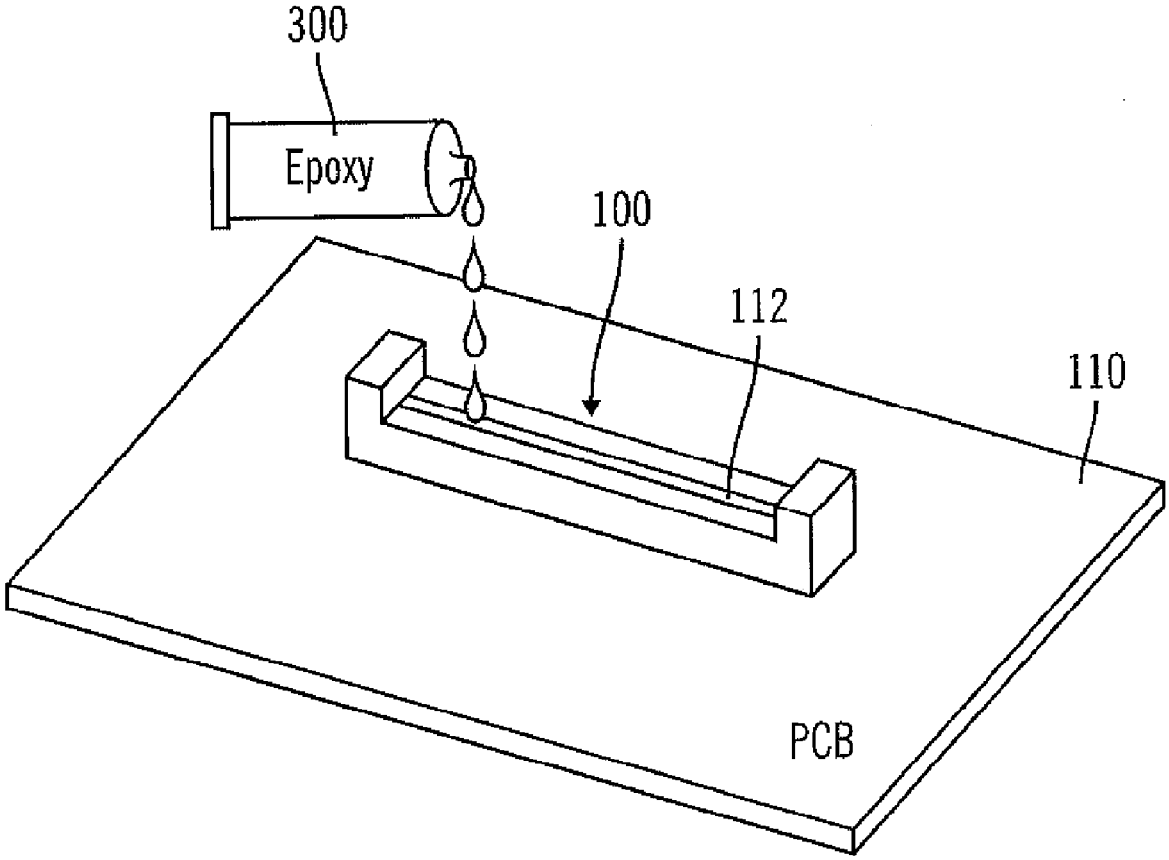
FIG. 3 is an elevational view of the component of FIG. 1 inserted into the PCB of FIG. 1 and filled with adhesive according to an embodiment of the present invention.

FIG. 3 shows the component 100 attached to the PCB 110 via the pins 102*a-n* inserted into the thru-holes 108*a-n*. Once the component 100 is inserted, the portion of the pins 102*a-n* that extend below the component 100 are no longer visible or accessible from the top portion of the board 110. Therefore, access to the pins for removal purposes is limited.

Figure 4:
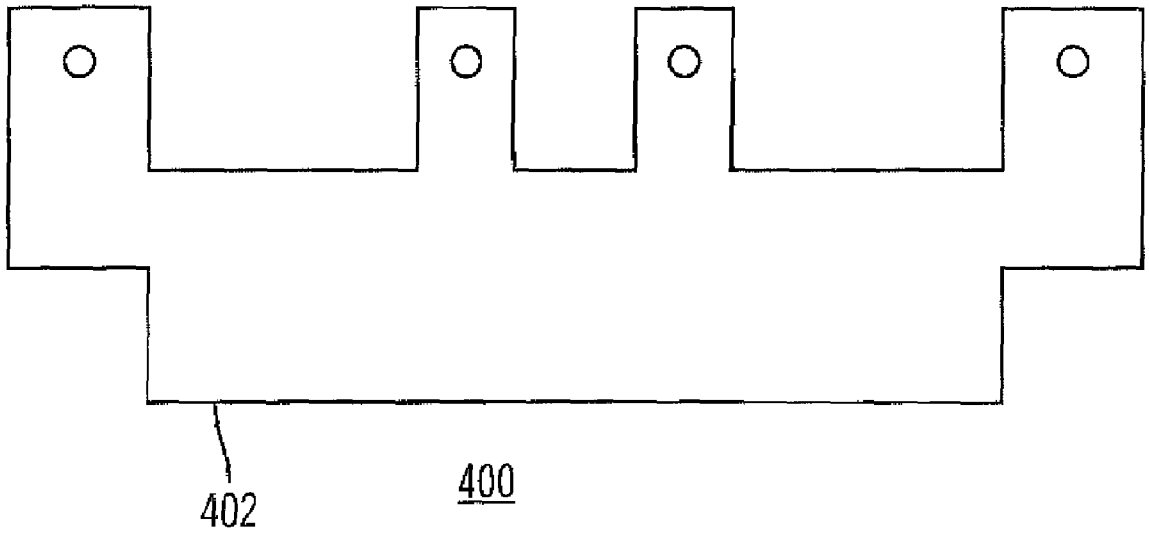
FIG. 4 is a planar view of an attachment member according to an embodiment of the present invention.

In accordance with an embodiment of the present invention, the slot 112 is at least partially filled with an adhesive material 300 such as epoxy. FIG. 4 shows a side view of one embodiment of an attachment member 400 that will be inserted into the slot portion 112 of the component 100. Bottom edge 402 of the attachment member 400 makes contact with the adhesive 300 and, after curing, solidly bonds the attachment member 400 to the component 100. Essentially, the attachment member 400 becomes an extension of the component and provides a superior shape for pulling the component.

The epoxy bond between the attachment member 400 and the component 100 provides a great advantage over the prior-art method of pulling on the component with tools, in that the epoxy provides a uniform bond to the entire slot and to each portion of the pins that is present in the slot. The epoxy is able to wick down into small places and grip the pins much more efficiently than any tool known in the art. The epoxy 300 is strong enough to allow the attachment member 400 to pull the component 100 out of the PCB without breaking the component 100. Because the bond is so strong between the attachment member 400 and the component 100, the attachment member 400 is disposable in some embodiments of the invention.

Figure 5:
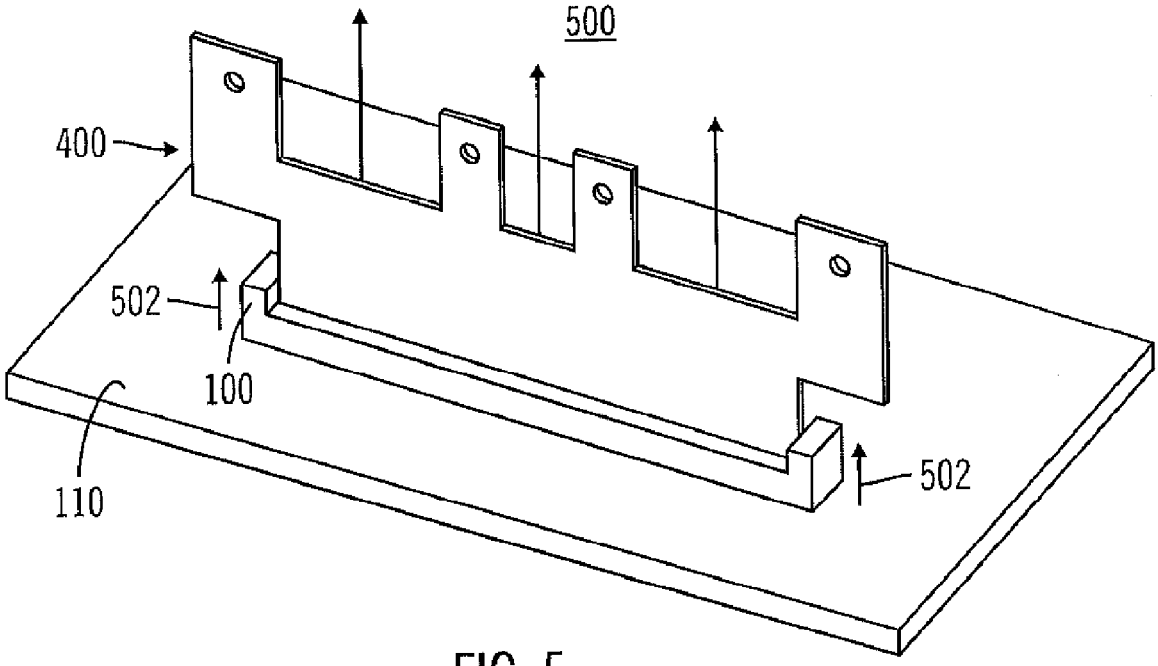
FIG. 5 is an elevational view of the attachment member of FIG. 4 inserted into the component of FIG. 1, which is inserted into the PCB of FIG. 1 according to an embodiment of the present invention.

FIG. 5 shows the attachment member 400 inserted in the component 100. Asserting a pulling force 500 on the attachment member 400, in turn pulls upwards on the component 300 through the epoxy bond and allows the component to be removed from the board. The adhesive adhering to both the body and the pins of the component increases the structural rigidity of the otherwise flimsy component assembly, allowing for a complete and clean extraction.

In some cases, the force need to remove the component causes the PCB or other medium to flex, thereby damaging the board 110. Therefore, one embodiment of the present invention provides a set of legs that straddle and sandwich the attachment member 400 and apply downward pressure on the board to counteract the upward pressure asserted by pulling on the attachment member 400 and does not exceed the allowable pressure on the PCB.

Figure 6:
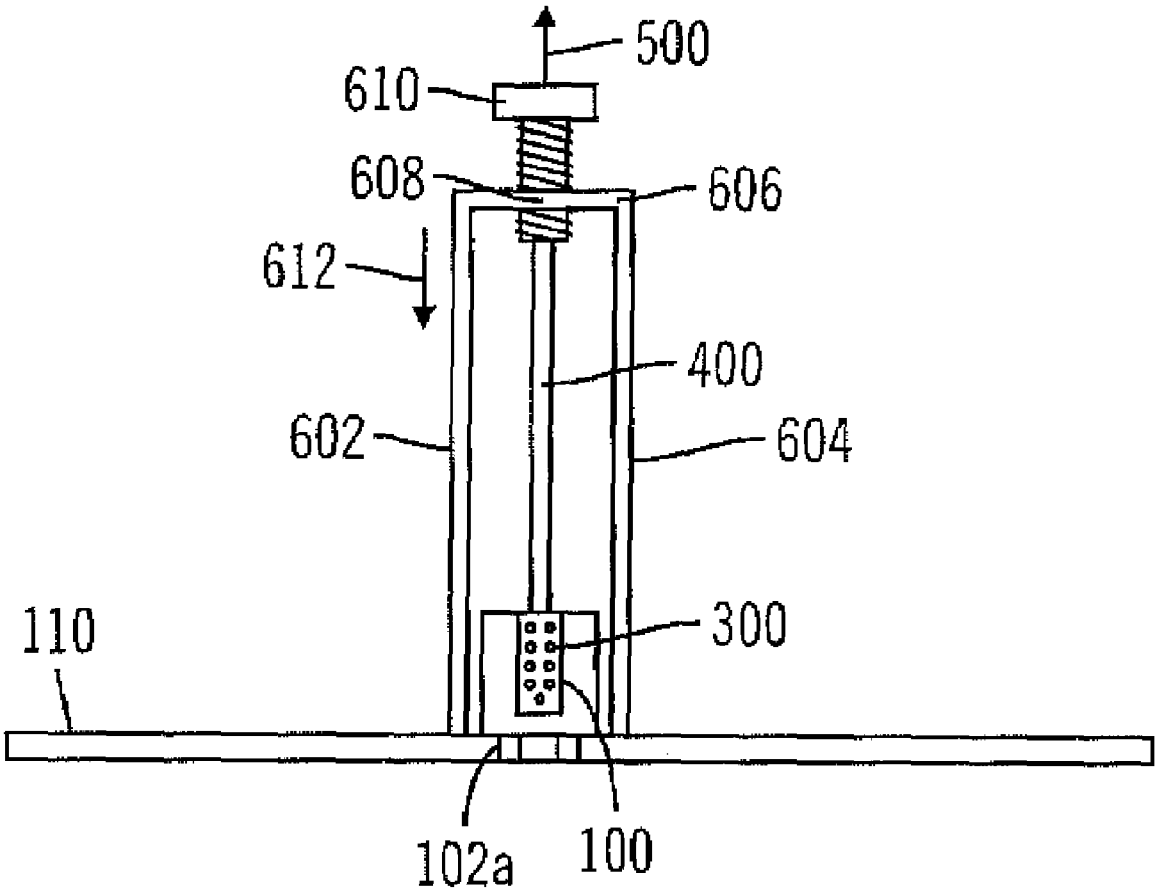
FIG. 6 is a side view of a pulling element coupled to the component of FIG. 1 and a set of legs according to an embodiment of the present invention.

FIG. 6 shows an edge view of the component 300 with the attachment member 400 inserted into the slot 112 and attached with epoxy 300. Adjacent the attachment member 400 is a first leg 602 and a second leg 604. In the particular embodiment shown, the legs 602 and 604 are attached together via member 606 that includes a threaded hole 608 for accepting a threaded member 610. The threaded member 610 is mechanically coupled to the attachment member 400. The particular method for attachment is unimportant, as long as the attachment provides sufficient strength to hold the attachment member 400 to the threaded member 610 during the removal process of the component 100. In this embodiment, when the threaded member 610 is turned, an upward force 500 is applied to the component 100 and an equal opposing downward force 612 is applied by the legs to the board 110. These two forces cancel each other out and advantageously prevent the board from flexing, thereby alleviating the damage caused by many prior-art component-removal techniques.

Figure 7:
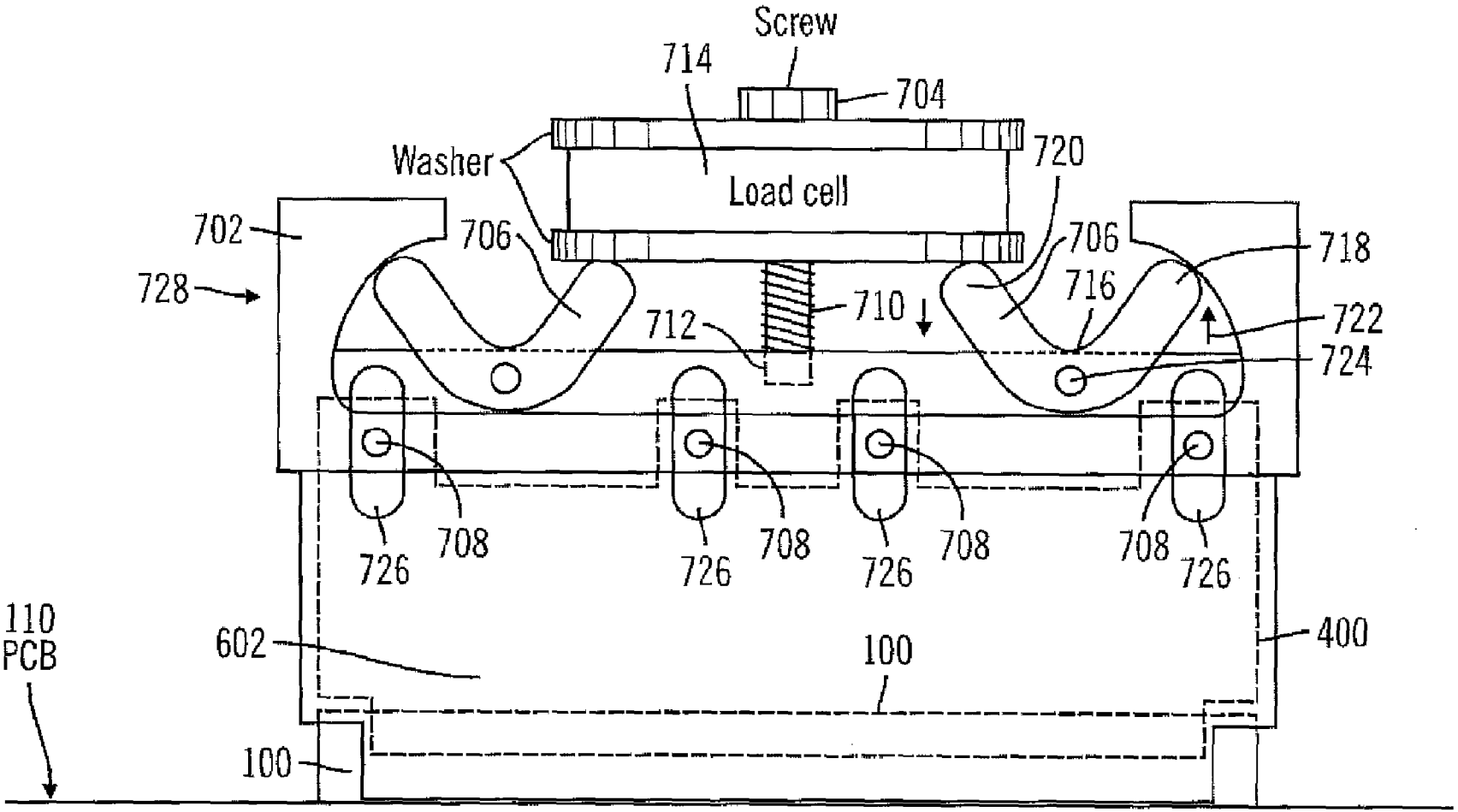
FIG. 7 is a side view of an embodiment of the present invention provided with a tensioner and a load cell and coupled to the component, which is attached to the PCB of FIG. 1 according to an embodiment of the present invention.

FIG. 7 shows a more detailed view of one example of the present invention. The particular embodiment shown is viewed from the side and includes a leg 602 that is attached to and part of a pulling assembly 728 that includes a body portion 702, a tensioner 704, and a set of lever arms 706. The pulling assembly 728 is fixedly attached to the legs 602, 604 and operable to exert force, through use of a set of pins 708 on the attachment member 400 in a direction opposite the PCB in which a component is inserted.

As the tensioner 704 is rotated, a threaded shaft 710 of the tensioner 704 screws into a threaded cylinder 712 causing the tensioner 704 to move in a downward direction 714. The tensioner makes contact with the lever arms 706. Each of the lever arms has a first end 720 for making contact with tensioner, a center section 716 pivotably attached to the legs 602, 604, and a second end 718 able to make contact with the body portion 702, that is coupled to the attachment member 400 via the pins 708. As the tensioner is rotated so that a downward force 714 is applied to the first end 720 of the lever arm 706, the center section 716 pivots along an axis 724 and causes the second end 718 to exert an upward force 722 on the body 702.

The upward force 722 moves the body 702 upward and away from the PCB 110. The body is mechanically coupled to the attachment member 400 with a set of pins 708 that are able to slide through groves 726 in the legs 602, 604. Therefore, when the upward force 722 moves the body 702 upward and away from the PCB 110, it takes with it the attachment member 400 and attached component 100.

In addition, a meter, or measuring device, such as a load cell can be utilized to record the connector extraction force. This data can be used to ensure product reliability and that manufacturing specifications are being met.

Figure 8:
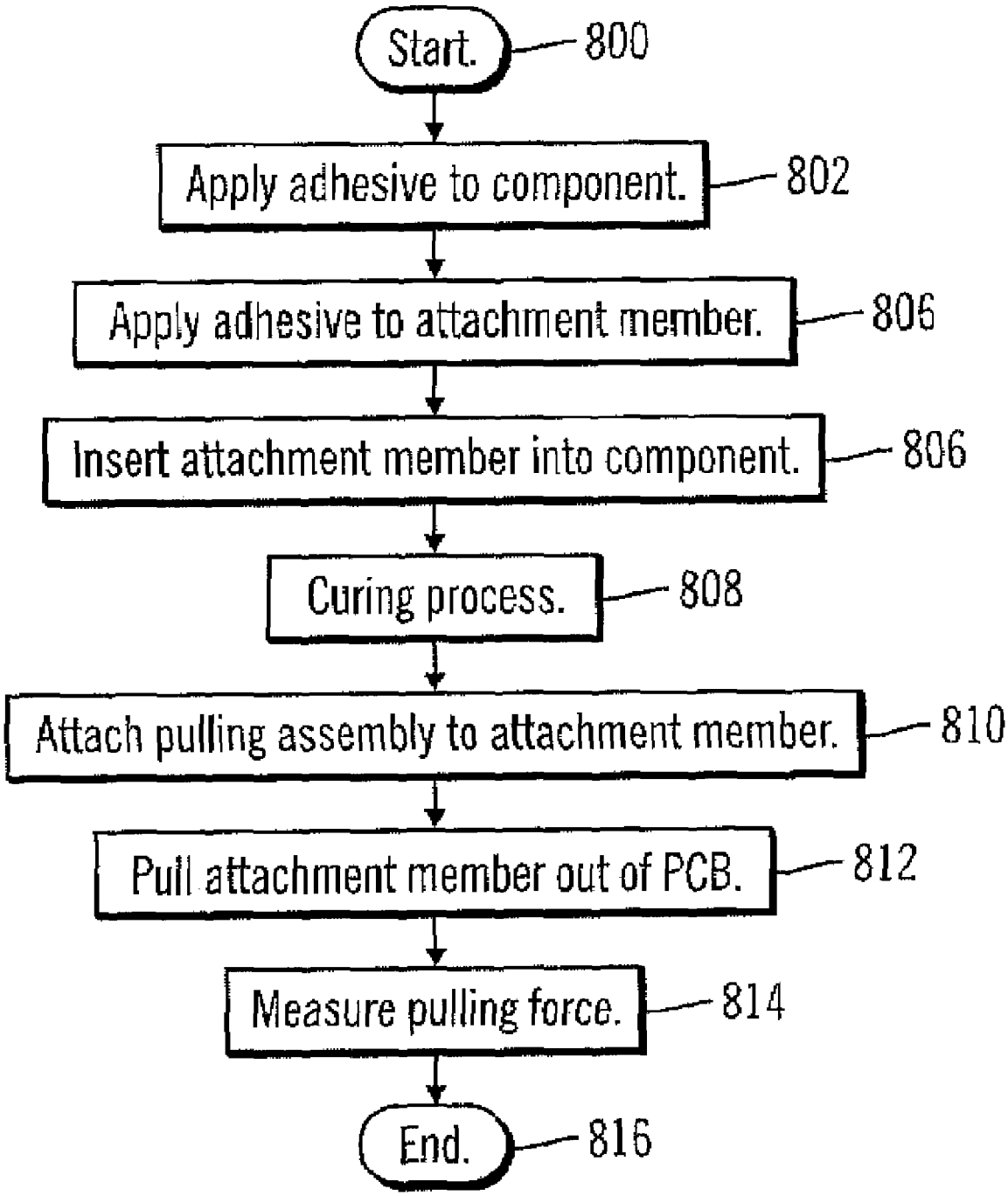
FIG. 8 is an operational flow diagram illustrating a component removal process according to embodiments of the present invention.

FIG. 8 is an operational flow diagram illustrating a component removal process according to embodiments of the present invention. The flow starts at step 800 and moves directly to step 802 where adhesive is applied to a portion of a component. Next, in step 804, adhesive is applied to a bottom edge of an attachment member and the attachment member is inserted into the portion of the component in step 806. The parts go through a curing process in step 808 to allow the adhesive to set up. Next, in step 810, a pulling assembly is attached to the attachment member. In one embodiment, the pulling assembly includes a set of legs and a tensioner that applies pressure to the attachment member by pushing down on the legs. The attachment member is pulled in step 812 with a pulling element in a direction opposite a medium in which the component is inserted. In step 814, a measurement of the force needed for component removal is read. The process ends in step 816.

Figure 9:
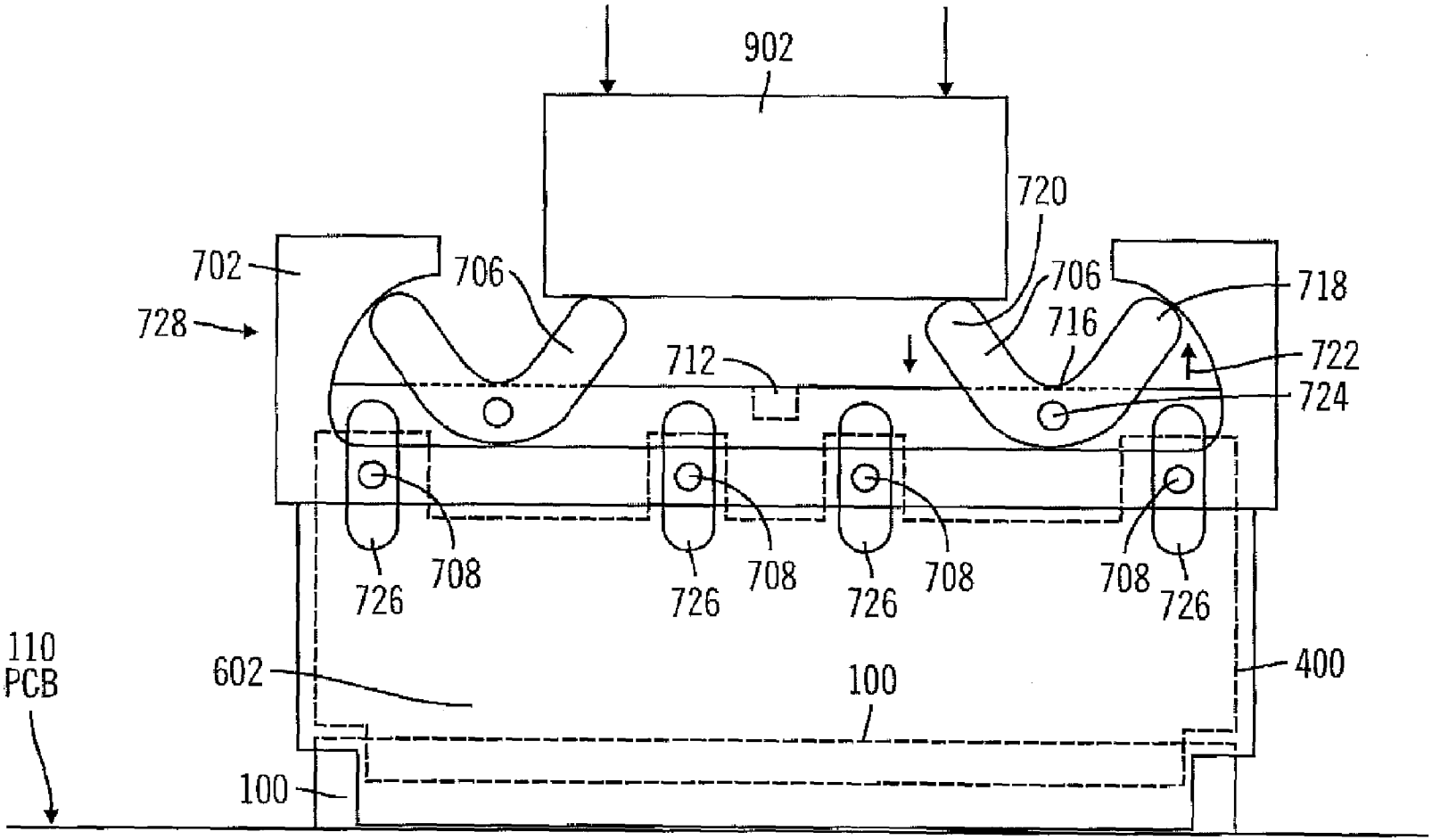
FIG. 9 is a side view of an embodiment of the present invention with a press device tensioner according to an embodiment of the present invention

FIG. 9 shows an alternative embodiment of the present invention, where a press 902, which can be any device that applies pressure, is used to apply pressure directly down in a direction toward the board. The press 902 places pressure on the lever arms 706 causing them to pivot at pivot points 724 and the second end 718 to exert an upward force 722 on the body 702. The upward force 722 then moves the body 702 upward and away from the PCB 110, as described above with reference to FIG. 7. This embodiment may require support on the opposite side of the board.

An embodiment of the present invention can provide great advantages over currently known methods of component removal. The invention obviates the need for destruction of the component or the PCB during removal. The adhesive adhering to both the body and the pins of the component increases the structural rigidity of the otherwise flimsy component assembly, allowing for a complete and clean extraction. The inventive apparatus and method is ergonomically friendly and not operator intensive.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A method for removing a component from a medium, the method comprising:

applying an adhesive into a slot portion of a component to be removed from a medium mechanically coupled thereto;

inserting, in response to applying the adhesive, an attachment member into the slot portion of the component where the adhesive is configured to create a uniform adhesive bond between the attachment member, the component, and a plurality of pins disposed on the component;

moving a tensioning member in a direction toward the medium in which the component is inserted, pressing, by the tensioning member in response to the moving thereof, a first portion of a plurality of lever arms in the direction toward the medium, wherein the plurality of lever arms are disposed underneath the tensioning member and above the attachment member and the component;

moving, in response to the pressing, a second portion of the plurality of lever arms in a direction opposite to the direction in which the component is inserted; and pulling, with a pulling element in response to the inserting, the attachment member via the adhesive bond in the direction opposite the direction in which the component is inserted, wherein the pulling comprises at least:

moving, by the second portion of the plurality of lever arms, in the direction that is opposite to the direction in which the component is inserted, a first portion of the pulling element; and pulling in the direction that is opposite to the direction in which the component is inserted a set of pins mechanically coupled to the attachment member and the pulling member.

2. The method according to claim 1, wherein the pulling element comprises:

a first leg;

a second leg opposing the first leg and sandwiching the attachment member; and the tensioner mechanically coupled to the attachment member and the first and second leg.

3. The method according to claim 2, wherein the pulling comprises:

turning the tensioner so as to cause the attachment member adhered to the component with the adhesive to move in a direction opposite the first and second legs.

4. The method according to claim 2, wherein the pulling comprises:

pressing with the tensioner in a direction toward the medium in which the component is inserted so as to cause the attachment member adhered to the component with the adhesive to move in a direction opposite the first and second legs.

5. The method according to claim 2, wherein the pulling comprises turning the tensioner so as to move a second end of at least one lever arm that includes:

a center section pivotably attached to one of the legs;

a first end attached to the attachment member; and the second end movable by the tensioner for causing the attachment member to move in a direction opposite the one of the legs.

6. The method according to claim 1, further comprising:

measuring a force used to pull the attachment member in a direction opposite the medium in which the component is inserted.

* * * * *